US010800056B2

(12) United States Patent
Kim et al.

(10) Patent No.: US 10,800,056 B2
(45) Date of Patent: Oct. 13, 2020

(54) RAZOR CARTRIDGE

(71) Applicant: DORCO CO., LTD., Seoul (KR)

(72) Inventors: Bo Ra Kim, Seoul (KR); Da Woon Han, Seoul (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 16/418,668

(22) Filed: May 21, 2019

(65) Prior Publication Data

US 2019/0351568 A1 Nov. 21, 2019

(30) Foreign Application Priority Data

May 21, 2018 (KR) ..... 10-2018-0057780

(51) Int. Cl.
*B26B 21/40* (2006.01)
*B26B 21/22* (2006.01)
*B26B 21/44* (2006.01)

(52) U.S. Cl.
CPC ..... *B26B 21/4012* (2013.01); *B26B 21/225* (2013.01); *B26B 21/227* (2013.01); *B26B 21/443* (2013.01)

(58) Field of Classification Search
CPC ... B26B 21/443; B26B 21/225; B26B 21/227; B26B 21/4068
See application file for complete search history.

(56) References Cited

U.S. PATENT DOCUMENTS 5,687,485 A 11/1997 Shurtleff et al.
5,761,814 A 6/1998 Anderson et al.
5,956,848 A 9/1999 Tseng et al.
5,956,851 A 9/1999 Apprille et al.
(Continued)

FOREIGN PATENT DOCUMENTS

CN 104440969 10/2017
KR 1020140120071 11/2014
(Continued)

OTHER PUBLICATIONS

Korean Intellectual Property Office Application No. 10-2018-0057780, Office Action dated May 28, 2019, 5 pages.
(Continued)

*Primary Examiner* — Hwei-Siu C Payer
(74) *Attorney, Agent, or Firm* — Lee, Hong, Degerman, Kang & Waimey

(57) ABSTRACT

A razor cartridge according to embodiments of the present disclosure includes a plurality of shaving blades, a blade housing including a blade seating space configured to receive the plurality of shaving blades in a second direction perpendicular to a first direction, and a pair of retainer clips configured to secure the plurality of shaving blades in the blade seating space, each retainer clip mounted at a corresponding side of the blade housing, wherein the pair of retainer clips are symmetrically shaped to each other, and wherein each of the pair of retainer clips includes a base portion positioned at a corresponding blade seating space, a first holding leg extending from the base portion in the first direction and wrapped around the blade housing, and a second holding leg extending from the base portion in the second direction and wrapped around the blade housing.

17 Claims, 11 Drawing Sheets

(56) References Cited

U.S. PATENT DOCUMENTS

| | | | | |
|---|---|---|---|---|
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,307,553 | B2 | 11/2012 | Follo et al. | |
| 9,539,734 | B1 * | 1/2017 | Bozikis | B26B 21/227 |
| 10,093,031 | B2 * | 10/2018 | Ren | B26B 21/4043 |
| 10,414,057 | B2 * | 9/2019 | Ntavos | B26B 21/4068 |
| 2012/0324737 | A1 * | 12/2012 | Howell | B26B 21/4031 30/50 |
| 2015/0082638 | A1 * | 3/2015 | Georgakis | B26B 21/222 30/77 |
| 2016/0297086 | A1 * | 10/2016 | Efthimiadis | B26B 21/4037 |
| 2018/0311845 | A1 * | 11/2018 | Moustakas | B26B 21/4012 |
| 2018/0354146 | A1 * | 12/2018 | Brellis | B26B 21/222 |
| 2018/0361604 | A1 * | 12/2018 | Bozikis | B26B 21/4018 |
| 2019/0351568 | A1 * | 11/2019 | Kim | B26B 21/4068 |
| 2020/0171686 | A1 | 6/2020 | Bozikis et al. | |

FOREIGN PATENT DOCUMENTS

| | | |
|---|---|---|
| KR | 20150034119 | 4/2015 |
| KR | 20170083962 | 7/2017 |
| KR | 1020170083962 | 7/2017 |
| WO | 9610473 | 4/1996 |
| WO | 2012158142 | 11/2012 |
| WO | 2015082002 | 6/2015 |
| WO | 2017103879 | 6/2017 |

OTHER PUBLICATIONS

European Patent Office Application Serial No. 19175478.7, Search Report dated Oct. 24, 2019, 8 pages.

State Intellectual Property Office of the People's Republic of China Application Serial No. 201910386772.6, Office Action dated Aug. 4, 2020, 5 pages.

* cited by examiner

RAZOR CARTRIDGE

CROSS-REFERENCE TO RELATED APPLICATIONS

Pursuant to 35 U.S.C. § 119(a), this application claims the benefit of earlier filing date and right of priority to Korean Patent Application No. 10-2018-0057780, filed on May 21, 2018, the contents of which are all hereby incorporated by reference herein in its entirety.

TECHNICAL FIELD

The present disclosure relates to a razor; more particularly to a razor having a retainer clip for providing a secure mounting of a plurality of shaving blades to a blade housing.

BACKGROUND

A conventional razor, commonly known as a wet razor, includes a razor cartridge and a razor handle, the razor cartridge generally having at least one razor blade disposed between the back of a guard bar and the front of a cap and having a blade housing for seating the blade. The razor cartridge is rotatably mounted on the razor handle so that it can pivot relative to the razor handle between the neutral position and the pivotal position.

In order to firmly seat these blades in the blade housings, a pair of retainer clips are generally used. Recently, as an example of coupling between the retainer clip and the blade housing, Korean Patent No. 1465872 suggests a retainer clip featuring two legs penetrating the blade housing at a through hole and encircling the blade housing, respectively, to fixedly engage the rear end of the blade housing. According to the Korean patent, two retainer clips are provided with first legs penetrating through holes formed in the front of the blade housing near both longitudinal ends thereof, and being bent and fixed at the rear of the blade housing. In addition, the retainer clips are provided with second legs encircling the blade housing and being bent and fixed at the rear of the blade housing.

This arrangement requires such a precision assembly, requiring the legs of the retainer clips to be accurately positioned in correspondence with the positions of the through holes during the engaging process of the retainer clips. In addition, even a slight misalignment between the legs and the through holes would not only obstruct the engaging process but also cause the legs having a relatively weak strength to be twisted or bent in abnormal positions, potentially leading to an increased failure rate during the engaging process.

In addition, as a consequence of the first and second legs of the retainer clip being formed to be very thin and long, as well as ending being improperly bent, they are highly susceptible to breakage, for example, tearing or cutting, during the bending of the legs around the blade housing, resulting in an increased defect rate.

The problems of the related art are not limited to those mentioned above, and other unmentioned problems can be clearly understood by those skilled in the art from the following description.

Therefore, the present disclosure in some embodiments seeks to provide a razor cartridge including therein a retainer clip for providing a secure fixing and stable and easy fastening of a blade to a blade housing.

In addition, the present disclosure seeks to provide a razor cartridge including therein a retainer clip capable of minimizing the defect rate and the breakage rate during the securing and fastening of thereof to the blade housing and of providing improved fastening reliability.

SUMMARY

At least one aspect of the present disclosure provides a razor cartridge, including a plurality of shaving blades, a blade housing comprising a blade seating space configured to receive the plurality of shaving blades in a second direction perpendicular to a first direction that is a shaving direction, and a pair of retainer clips configured to secure the plurality of shaving blades in the blade seating space, each retainer clip mounted at a corresponding side of the blade housing, wherein the pair of retainer clips are symmetrically shaped to each other, and wherein each of the pair of retainer clips comprises: a base portion positioned at a corresponding blade seating space; a first holding leg extending from the base portion in the first direction and wrapped around the blade housing; and a second holding leg extending from the base portion in the second direction and wrapped around the blade housing.

The base portions may cover both ends of the blade seating space and a length of the base portion in the first direction is greater than or equal to a length of the blade seating space in the first direction.

In one embodiment, an end portion of each of the base portions extends past a front most shaving blade among the plurality of shaving blades toward a front of the razor cartridge.

In one embodiment, the blade housing may further include recessed portions at the corresponding sides of the blade housing configured to accommodate the retainer clips such that the retainer clips are secured in position.

In some embodiments, each of the recessed portions comprises channels extending across edges of the blade housing.

In some embodiments, at least one of the base portion, the first holding leg, or the second holding leg of each of the retainer clips comprises at least one protrusion, and a corresponding recessed portion comprises at least one depression corresponding to the at least one protrusion.

In some embodiments, each recessed portion comprises a receiving groove configured to accommodate the base portion, a first wrapping channel extending from the receiving groove and configured to accommodate the first holding leg, and a second wrapping channel extending from the receiving groove and configured to accommodate the second holding leg.

In some embodiments, the blade seating space is formed at a front side of the blade housing and the first holding leg of the retainer clip is configured to wrap around the blade housing from the front side to a rear side of the blade housing opposite the front side.

In an embodiment, the first wrapping channel extends from the front side to the rear side of the blade housing to accommodate the first holding leg therein.

In some embodiments, a distal end of the first holding leg is formed with a first hook, the rear side of the blade housing is formed with a first notch corresponding to the first hook, and the first notch is configured to receive the first hook.

In some embodiments, the blade seating space is formed at a front side of the blade housing and the second holding leg of the retainer clip is configured to wrap around the blade housing from the front side to a rear side of the blade housing opposite the front side.

In some embodiments the second wrapping channel extends from the front side to the rear side of the blade housing to accommodate the second holding leg therein.

In some embodiments, a distal end of the second holding leg is formed with a second hook, the rear side of the blade housing is formed with a second notch corresponding to the second hook, and the second notch is configured to receive the second hook.

Other specific details of the present disclosure are included in the detailed description and drawings.

With the razor cartridge according to at least one embodiment of the present disclosure, the retainer clip has first and second leg portions, which when bent to surround the blade housing, resist warping, breakage, tearing or other faults, enhancing the reliability thereof, thus reducing the defect rates.

In addition, with the razor cartridge according to at least one embodiment of the present disclosure, the retainer clip may have such a coupling structure capable of securing the blades to the blade housing while providing sufficient widths to both the blades and the front side guard bar of the blade housing.

Further, according to at least one embodiment of the present disclosure, the coupling structure of the retainer clip and the blade housing are advantageously simplified.

The effects according to the present disclosure are not limited by those exemplified above, and more various effects are included in the specification.

DETAILED DESCRIPTION

Figure 1A:
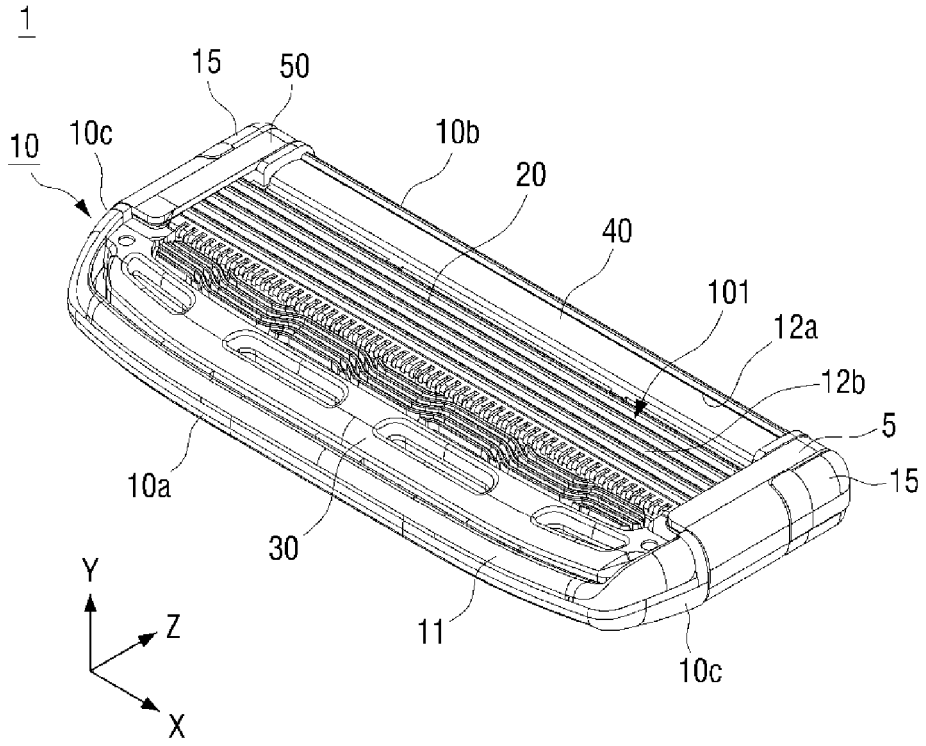
FIG. 1 A is a perspective view in one direction of a razor cartridge according to at least one embodiment of the present disclosure.
FIG. 1B is a bottom view of a razor cartridge according to at least one embodiment.

Various embodiments of the present disclosure will now be described with reference to the accompanying drawings.

It should be understood, however, that the present disclosure is not intended to be limited to the particular embodiments, but includes various modifications, equivalents, and/or alternatives of the embodiments of the disclosure. In connection with the description of the drawings, like reference numerals designate like elements throughout the specification.

The terminology used herein is for the purpose of describing particular embodiments only and is not intended to limit the scope of the other embodiments. The singular expressions may include plural expressions unless the context clearly dictates otherwise. All terms used herein, including technical or scientific terms, may have the same meaning as commonly understood by one of ordinary skill in the art of the present disclosure. Commonly used lexically defined terms may be interpreted to have the same or similar meaning as the contextual meanings of the related art and are not to be construed as ideal or overly formal in meaning unless expressly defined in this document. In some cases, even the terms defined herein may not be construed to exclude embodiments of the present disclosure.

Hereinafter, a razor cartridge according to some preferred embodiments of the present disclosure will be described in detail with reference to the accompanying drawings.

Figure 1B:
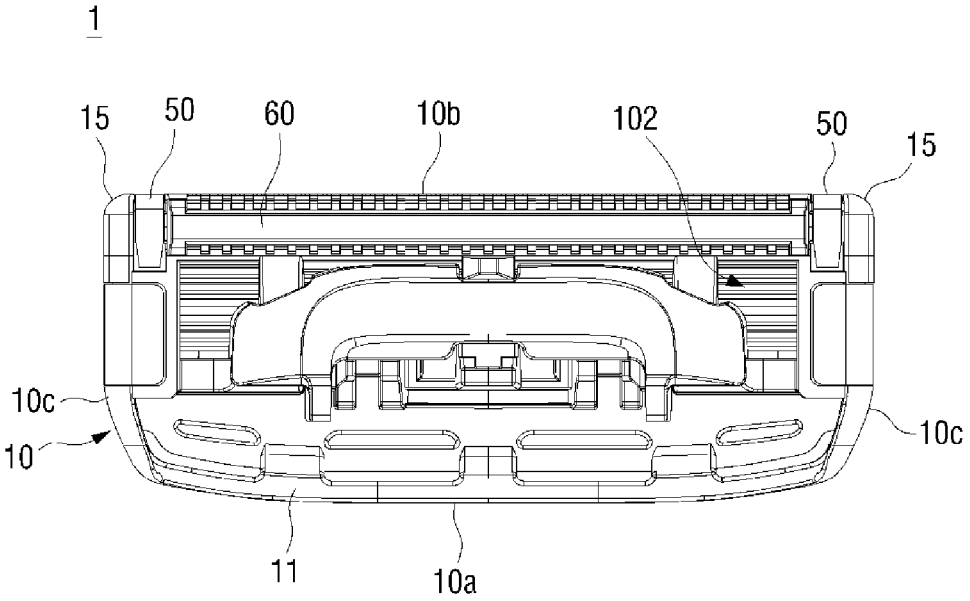

FIG. 1A is a perspective view in one direction of a razor cartridge according to at least one embodiment of the present disclosure. FIG. 1B is a bottom view of a razor cartridge according to at least one embodiment of the present disclosure.

Hereinafter, for convenience of explanation of a razor cartridge according to at least one embodiment of the present disclosure, the left and right directions of the cartridge as viewed in FIG. 1A are referred to as an X-axis direction and a negative X-axis direction, respectively, the up and down directions of the cartridge as in FIG. 1A are referred to as a Y-axis direction and a negative Y-axis direction, respectively, and the front and back directions thereof are referred to as a Z-axis direction and a negative Z-axis direction, respectively. Accordingly, the shaving direction may correspond to the Z-axis direction, being defined herein as the first direction. In addition, the longitudinal direction perpendicular to the shaving direction may correspond to the X-axis direction, being defined herein as the second direction. In the present specification, the X, Y, and Z axes are defined as above, and the present disclosure will be described below with reference to the X, Y, and Z axes defined above. However, the X, Y, and Z axes defined above are merely for convenience of description of the present disclosure, and do not limit the scope of the present disclosure.

Referring to FIGS. 1A and 1B, a razor cartridge according to at least one embodiment includes features for cutting body hair in contact with a user's skin. For example, the razor cartridge may include one or more shaving blades 20 for cutting hair, a blade housing 10 for receiving the shaving blades 20, a lubrication member 40, a guard bar 11, a pair of retainer clips 50, and the like. Although not shown, the razor cartridge may be coupled with a handle.

The blade housing 10 may be mounted with at least one shaving blades 20, an elastic member 30, a guard bar 11, a pair of retainer clips 50, a trimmer 60, and the like. The blade housing 10 has a first side 101 adapted to contact the user's skin and a second side 102 coupled with a handle. For convenience of explanation, 'first side 101' of the blade housing 10 may indicate a side where the blade housing 10 contacts the skin. In addition, a side opposite to the first side 101 of the blade housing 10, that is, the opposite side may be referred to as 'second side 102'. The blade housing 10 may have four circumferential sides. Of the four circumferential sides of the blade housing 10, a side of the blade housing 10 which the edges of the shaving blades 20 face is referred to as a first face 10*a* or 'front circumferential side', a side opposite to the first face 10*a* is referred to as a second face 10*b* or 'rear circumferential side', and lateral sides of the blade housing 10 between the first face 10*a* and the second face 10*b* are referred to as first side and second side faces 10*c*. However, the terms such as the first side 101, second side 102 and the first face 10*a*, second face 10*b* and first/second side faces 10*c* are merely for sake of convenient description, but not for limitation thereto.

The blade housing 10 according to at least one embodiment is provided at a front end of the first side 101 with a guard bar 11 on which the elastic member 30 is mounted. However, the presence or absence of the elastic member 30 may be determined according to the shape and configuration of the razor 1. In addition, the blade housing 10 may be provided at a rear end of the first side 101 with a receiving space 12*a* in which the lubrication member 40 is mounted. However, the features of the receiving space 12*a* and the lubrication member 40 may be omitted depending on the configuration, form, or use of the razor, and the like. In the receiving space 12*a*, guard rubber or a comb guard or the like may be mounted in place of the lubrication member 40. Further, in the blade housing 10, the elastic member 30 and the lubrication member 40 may be provided therebetween a seating space 12*b* in which at least one shaving blade 20 is mounted. At least one embodiment may be provided with the at least one shaving blade 20, more specifically, a plurality of shaving blades 20. The seating space 12*b* may be elongated in the second direction perpendicular to the shaving direction. Accordingly, the shaving blades 20 may be disposed adjacent to each other in the first direction, which is the shaving direction, while being accommodated in the seating space 12*b* extending in the second direction perpendicular to the first direction.

In addition, the blade housing 10 may be formed on its side faces 10*c* with channels 13 and stepped portions or tiered portions 15. The channels 13 may be provided with a pair of retainer clips 50 mounted thereon, and the tiered portions 15 may be provided to limit the pair of retainer clips 50 from moving or drifting from the channels 13 and to keep them in position. The pair of retainer clips 50 can fix the shaving blades 20 accommodated in their seating space 12*b* to the blade housing 10, and they may have a structure symmetrical to each other.

A trimmer 60 may be disposed on the second side of the blade housing 10. The trimmer 60 has a separate fastening structure and can be fixed directly to the blade housing 10. Alternatively, the trimmer 60 may be fixed to the blade housing 10 via a fixing member such as an adhesive member. In addition, the trimmer 60 may be fixed to the blade housing 10 with assistance from the retainer clips 50 of some embodiments, which are coupled to the blade housing 10 from its first side to the second side. The fixing structure of the trimmer 60 can be explained by explaining the fixing structure of the retainer clip 50.

Figure 2A:
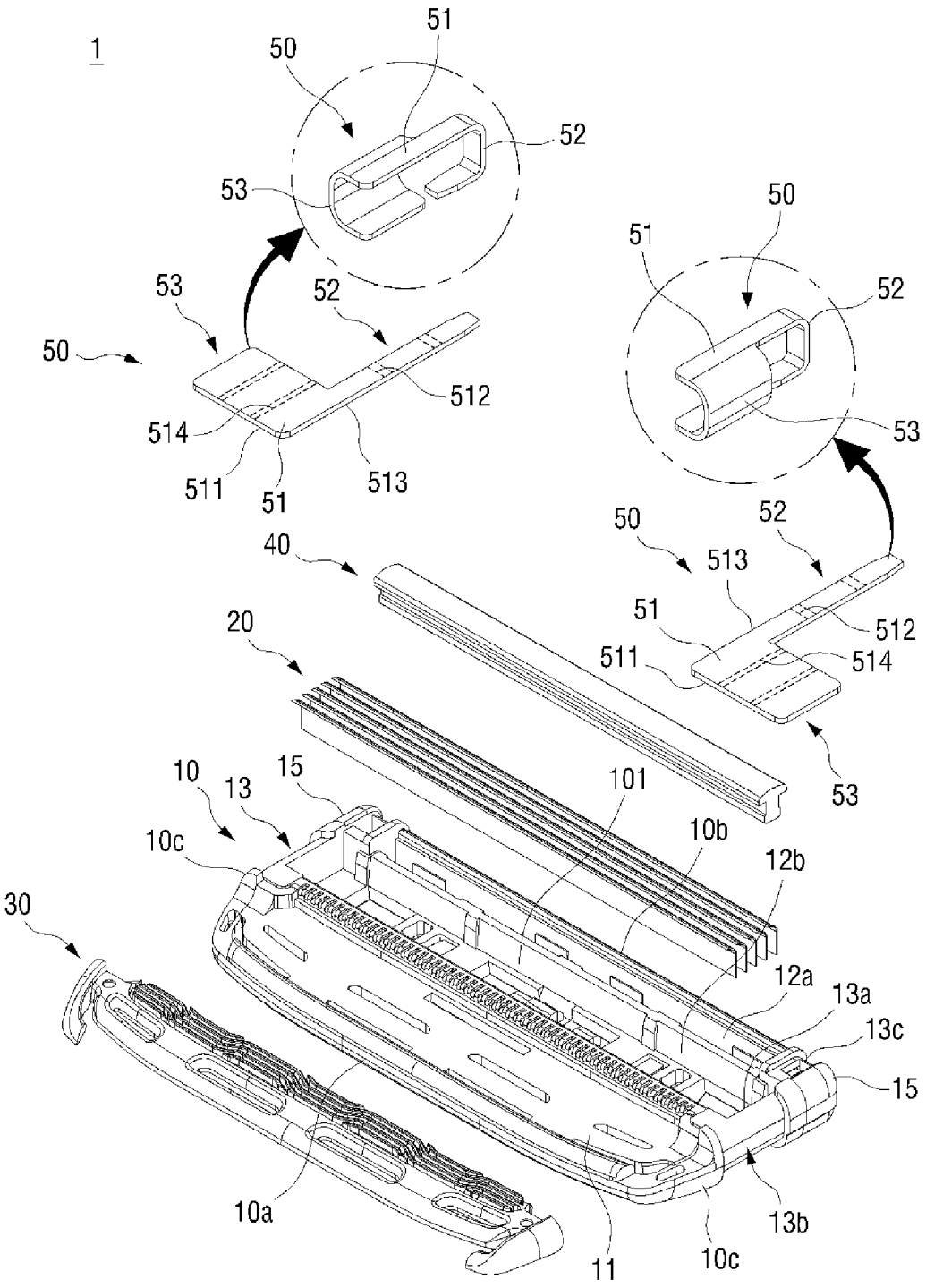
FIG. 2A is an exploded perspective view in one direction of a razor cartridge according to at least one embodiment.
Figure 2B:
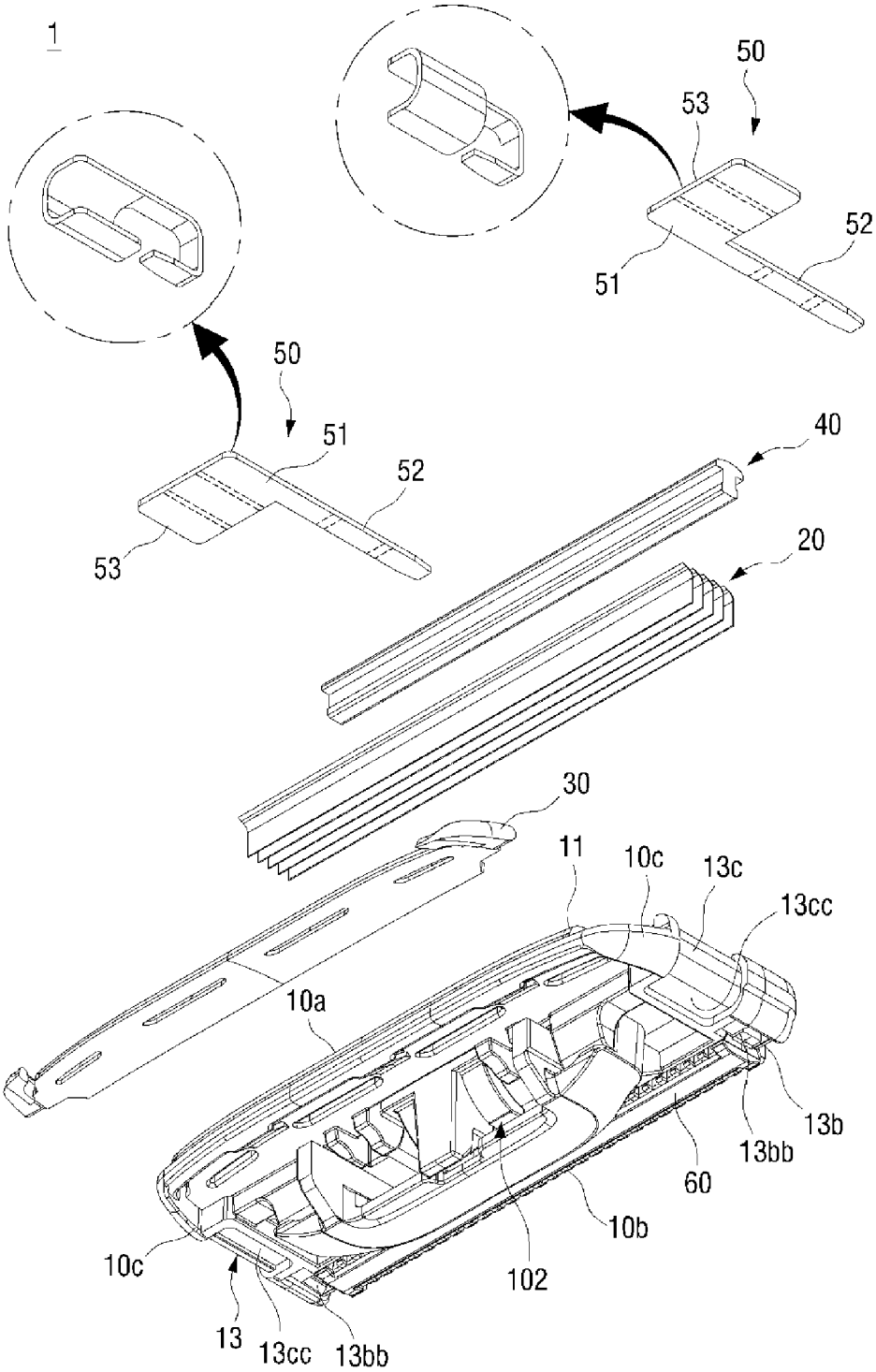
FIG. 2B is an exploded perspective view in the other direction of a razor cartridge according to at least one embodiment.
Figure 3:
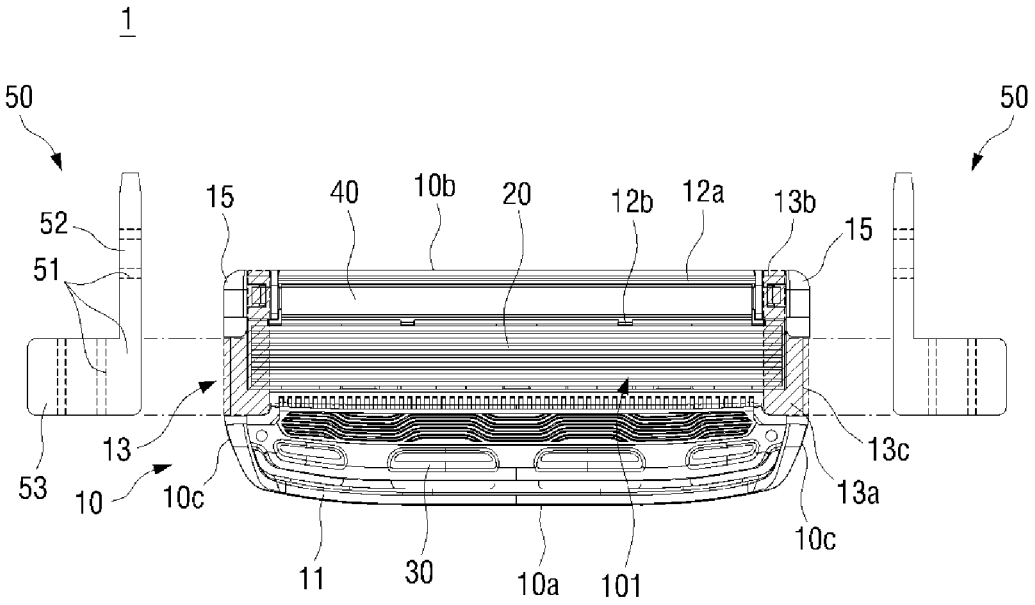
FIG. 3 is a plan view of retainer clips and a blade housing in a razor cartridge before coupling therebetween, according to various embodiments of the present disclosure.

FIG. 2A is an exploded perspective view in one direction of a razor cartridge according to at least one embodiment. FIG. 2B is another exploded perspective view of a razor cartridge according to at least one embodiment. FIG. 3 is a plan view of retainer clips 50 and a blade housing 10 in a razor cartridge before coupling therebetween, according to various embodiments of the present disclosure.

Referring to FIGS. 2A to 3, in at least one embodiment, the retainer clips 50, channels 13, and tiered portions 15 are respectively provided at both side ends of the blade housing 10. The blade housing 10 is provided at one side end with each retainer clip 50, channel 13 and tiered portion 15 and is symmetrical to that of the blade housing 10 at the opposite side end provided with another retainer clip 50, channel 13 and tiered portion 15. Therefore, in the following description, a reference to the retainer clip 50, channel 13, or tiered portion 15 is meant to cover the symmetrical opposite counterparts on both side ends of the blade housing 10, respectively.

In at least one embodiment, the retainer clip 50 includes a base 51, a first holding leg 52 and a second holding leg 53.

The base 51 according to at least one embodiment is disposed at either side end of the seating space 12*b* and covers a part or all of the seating space 12*b* and a part of either side end of the blade housing 10. The length of the base 51 in the first direction may be equal to or longer than the length of the seating space 12*b* in the first direction of the shaving blades 20. For example, when the seating space 12*b* has a first width of 'a', the length of the base 51 in the first direction may be 'a' or 'a+α'. However, the base 51 may be formed to cover not all the seating space 12*b*. Rather, the base 51 and the first holding leg 52 may be formed to jointly cover the seating space 12*b* in its entirety. In addition, the base 51 may have its end disposed further forward than the front most one of the shaving blades 20. For example, the base 51 may be elongated such that its end is located ahead of the blade edge of the front most shaving blade 20. The other end of the base 51 may also be longer than the span length of the rearmost shaving blade 20. Therefore, the base 51 may cover the front most to the rearmost of the shaving blades 20 in their entirety. Alternatively, the base 51 and the first holding leg 52 may cover the front most to the rearmost of the shaving blades 20 in their entirety. This may fix and completely cover both side ends of the shaving blades 20 received in the seating space 12*b* such that there is no space allowing separation of the shaving blades 20 from the seating space 12*b*. The paired retainer clips 50 may have a shape symmetrical to each other.

The base 51 according to at least one embodiment can be described as having, for example, a rectangular shape with a length in the first direction longer than a length in the second direction and a predetermined protrusion in the first direction. However, the base 51 is not limited to a rectangular shape, and any shape or modification can be made as long as it can fix the shaving blades 20 to the seating space 12*b*. Various shapes of the base 51 will be described in detail below with reference to FIG. 4. As described above, since the base 51 has a rectangular shape, the periphery of the base 51 may form four sides. Of the four sides of the base 51, a first end portion 511 refers to a base end near the front side of the blade housing 10, a second end portion 512 refers to a base portion formed on the opposite side to the first end portion 511, a third end portion 513 refers to a base end formed between the first end portion 511 and the second end portion 512 and over the shaving blades 20 to cover thereof, and a fourth end portion 514 refers to a base portion that is formed on the opposite side to the third end portion 513 and is close to the side face of the blade housing 10. However, the first end portion 511 to the fourth end portion 514 are only defined for convenience of explanation, and they are, of course, subject to changes or modifications made depending on the shape and structure of the base 51.

The first holding leg 52 according to at least one embodiment extends from the second end portion 512 of the base 51 in the first direction. The first holding leg 52 formed in the first direction may be formed to be bent in a manufacturing process. The first holding leg 52 may be bent from the front of the blade housing 10 so as to surround the second face 10*b* or rear circumferential side of the blade housing 10 in the first direction. In particular, the first holding leg 52 is bent into a generally C-shaped configuration so that it rests on a first wrapping channel 13*b* formed in the blade housing 10, extending from the first side 101 over the circumferential second face 10*b* to the rear second side 102, which will be detailed below. As described above, interference may occur with the first holding leg 52 due to mounting of, for example, the lubrication member 40 or the elastic member 30 on the front side of the blade housing 10. Therefore, the first holding leg 52 may be provided to have the smallest possible area with strength for fixing or supporting force to minimize the occurrence of interference with the structures provided on the front side of the blade housing 10.

The second holding leg 53 according to at least one embodiment extends from the fourth end portion 514 of the base 51 in a second direction. The second holding leg 53 formed in the second direction may be bent in the manufacturing process. The second holding leg 53 may be bent from and around the side face 10*c* next to the first side 101 of the blade housing 10 in the second direction. In other words, the second holding leg 53 is bent into a generally backward C-shaped configuration so that it rests on a second wrapping channel 13*c* formed in the blade housing 10, extending from and around its side face 10*c* next to the first side 101 to the second side 102. The second holding legs 53 may be sized and secured to fully utilize the width of the side face 10*c* of the blade housing 10 of the razor cartridge.

Figure 4:
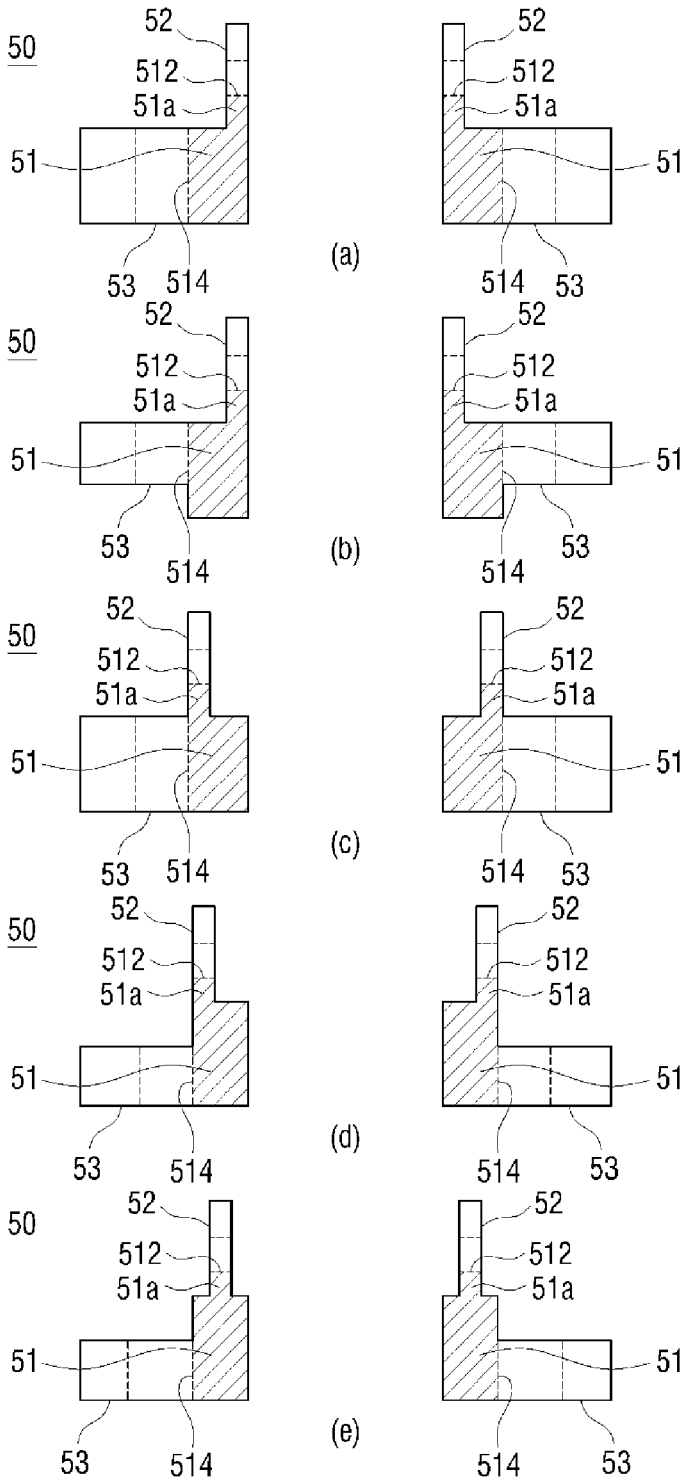
FIG. 4 is views of variations of a retainer clip in a razor cartridge according to at least one embodiment.

FIG. 4 is views of variations of the retainer clip 50 in a razor cartridge according to at least one embodiment.

Referring to FIG. 4, according to some embodiments, the base 51, the first holding leg 52 and the second holding leg 53 can be implemented in various forms as shown at FIGS. 4(*a*) to 4(*e*).

For example, as shown in FIG. 4(*a*), the second end portion 512 of the base 51 is connected to the first holding leg 52, including an extension protrusion 51*a* formed protruding so as to have the same width as the first holding leg 52. In addition, the base 51 has its fourth end 514 connected to the second holding leg 53 which has a width equal to or somewhat smaller than that of the fourth end 514. In the case of FIG. 4(*a*), the extension protrusion 51*a* protrudes from the second end portion 512 but it can be cited as shaped to extend from the third end portion 513, and the second holding leg 53 as shaped to extend over the same width as the fourth end portion 514.

In the case of FIG. 4(*b*), the extension protrusion 51*a* protrudes from the second end portion 512, with the first holding leg 52 shaped as protruding from the extension protrusion 51*a* of the second end portion 512. In addition, the second holding leg 53 may have a width smaller than that of the fourth end portion 514, and it can be cited as shaped to extend from the second end portion 512.

In FIG. 4(*c*), the extension protrusion 51*a* protrudes from a predetermined position of the second end 512, and the first holding leg 52 protrudes from the protrusion 51*a* of the second end 512. In addition, the second holding leg 53 may have the same width as the fourth end 514, and it can be cited as shaped to extend from the fourth end 514.

In FIG. 4(*d*), the extension protrusion 51*a* protrudes from the second end portion 512, and the first holding leg 52 may extend from the extension protrusion 51*a*. The second holding leg 53 may have a width smaller than that of the fourth end portion 514, and it can be cited as shaped to extend from the first end portion 511.

In the case of (e) of FIG. 4, the extension projection 51*a* protrudes from a predetermined position of the second end portion 512, and the first holding leg 52 may have a shape extending from the extension projection 51*a* of the second end portion 512. The second holding leg 53 may have a width smaller than that of the fourth end portion 514, and it can be cited as shaped to extend from the first end portion 511.

The example shapes of the retainer clip 50 have been illustrated as in FIGS. 4(*a*) to 4(*e*), but the present disclosure is not limited thereto. The retainer clip 50 may have any other modified or altered shapes as long as it fixes the shaving blades 20 in the blade housing 10, and has the base 51, the first holding leg 52 and the second holding leg 53.

Returning to FIGS. 1 to 3, on both sides of the blade housing 10 according to at least one embodiment, the channels 13 for accommodating and fixing the retainer clips 50 and tiered portions 15 may be provided, respectively. The channels 13 may be adapted to accommodate and fix the retainer clips 50, and the tiered portions 15 may be provided to limit the pair of retainer clips 50 mounted in the channels 13 from moving around and to keep them in positions.

The channels 13 may be formed along the circumferences of the side faces and the upper surface of the blade housing 10 and may have a predetermined recessed shape on the surface of the blade housing 10. Specifically, each channel 13 may include the receiving groove 13*a*, the first wrapping channel 13*b*, and the second wrapping channel 13*c*.

Each receiving groove 13*a* may be located at either side of the first surface 101 of the blade housing 10, and in the receiving groove 13*a*, the base 51 of the retainer clip 50 may be seated. The receiving groove 13*a* may include an overlapping portion that overlaps with the seating space 12*b*. The receiving groove 13*a* desirably conforms to the base 51. In one embodiment, the receiving groove 13*a* may be formed into a L-shaped configuration, for example. However, the receiving groove 13*a* may not conform to the base 51.

The first wrapping channel 13*b* may extend from the receiving groove 13*a* in the first direction of the blade housing 10. The first wrapping channel 13*b* may be provided so that it connects to the receiving groove 13*a* at one end thereof and extends from the first surface 101 of the blade housing 10 along its second face 10*b* to the second surface 102 of the blade housing 10. In addition, the second surface 102 of the blade housing 10 may be formed with a third wrapping channel 13*bb* which is connected to the first wrapping channel 13*b*. In other words, the first wrapping channel 13*b* may have a generally backward C-shaped configuration along the second face 10*b* of the blade housing 10. More specifically, the first wrapping channel 13*b* and the third wrapping channel 13*bb* are combined to form a generally backward C-shaped recessed grooves extending from first surface 101 of the blade housing 10 to its second surface 102. In at least one embodiment, the backward C-shaped groove is formed through the first wrapping channel 13*b* and the third wrapping channel 13*bb*. However, the first wrapping channel 13*b* alone may form the backward C-shaped groove. The first wrapping channel 13*b* alone or the first wrapping channel 13*b* and the third wrapping channel 13*bb* combined may receive and seat the first holding leg 52 of the retainer clip 50.

The second wrapping channel 13*c* may extend from the receiving groove 13*a* in the second direction of the blade housing 10. The second wrapping channel 13*c* may be provided so that it connects to the receiving groove 13*a* at a side end thereof and extends from the side face 10*c* of the blade housing 10 along a circumferential lateral side to the second surface 102 of the blade housing 10. In addition, the second surface 102 of the blade housing 10 may be formed with a fourth wrapping channel 13*cc* which is connected to the second wrapping channel 13*c*. In other words, the second wrapping channel 13*c* may have a generally backward C-shaped configuration circumferentially of the side face 10*c* of the blade housing 10. More specifically, the second wrapping channel 13*c* and the fourth wrapping channel 13*cc* are combined to form a generally backward C-shaped recessed grooves extending from first surface 101 of the blade housing 10 to its second surface 102. In at least one embodiment, the backward C-shaped groove is formed through the second wrapping channel 13*c* and the fourth wrapping channel 13*cc*. However, the second wrapping channel 13*c* alone may form the backward C-shaped groove. The second wrapping channel 13*c* alone or the second wrapping channel 13*c* and the fourth wrapping channel 13*cc* combined may receive and seat the second holding leg 53 of the retainer clip 50.

The stepped or tiered portion 15 may be formed at both side edges of the blade housing 10 according to at least one embodiment. The tiered portion 15 may be formed as a raised shoulder that is adjacent to and protrudes from the channel 13. When the retainer clip 50 is seated on the channel 13, the retainer clip 50 can be blocked by the tiered portion 15 and restricted from drifting in the first and second directions. Accordingly, the retainer clip 50 can be accommodated in the channel 13 while being restricted in the first and second directions and being held immobilized in the channel 13. The tiered portion 15 may have a different shape depending on that of the channel 13 and of the retainer clip 50.

Figure 5A:
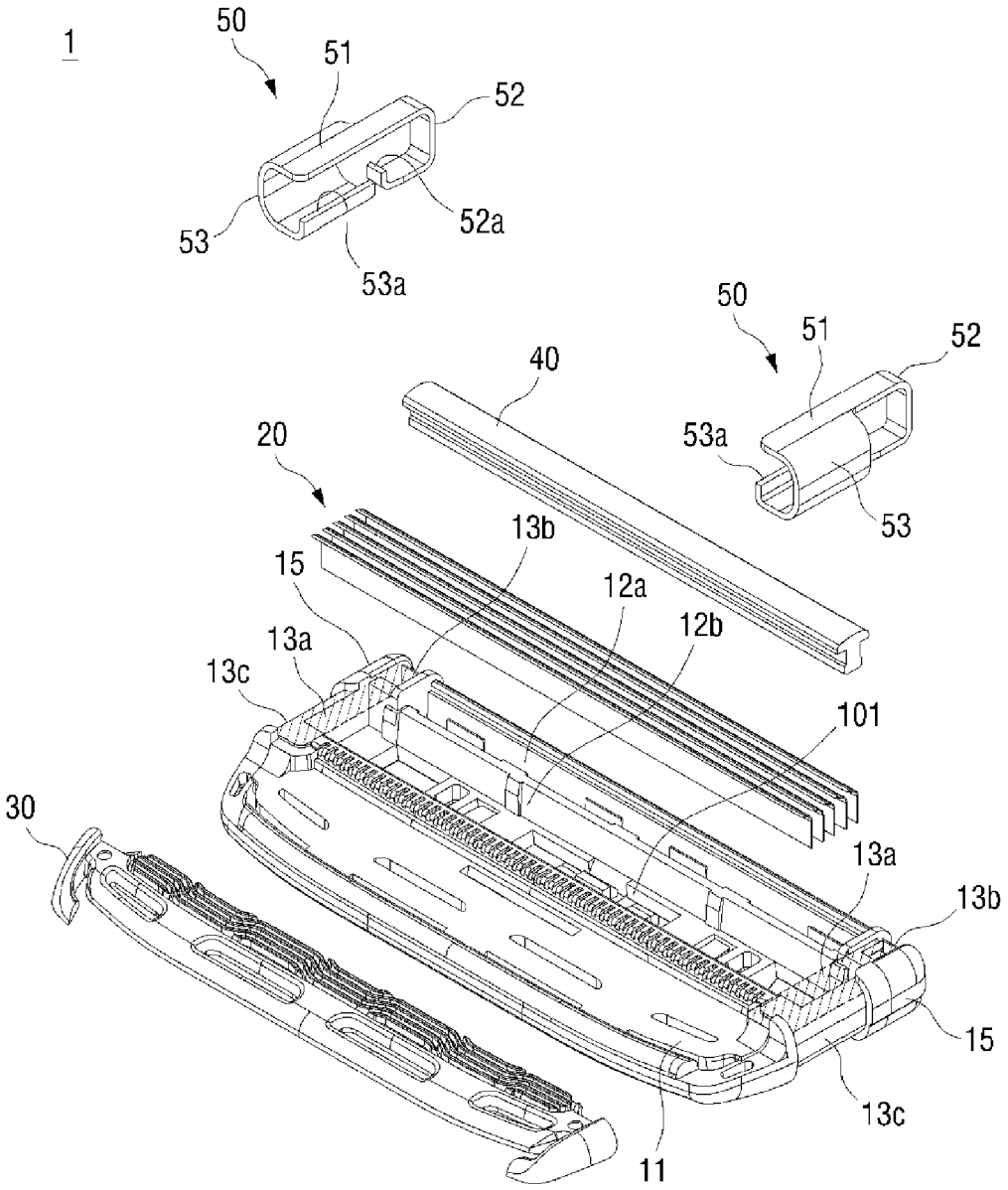
FIG. 5A is an exploded perspective view in one direction of another embodiment of the retainer clips and channels in a razor according to at least one embodiment.
Figure 5B:
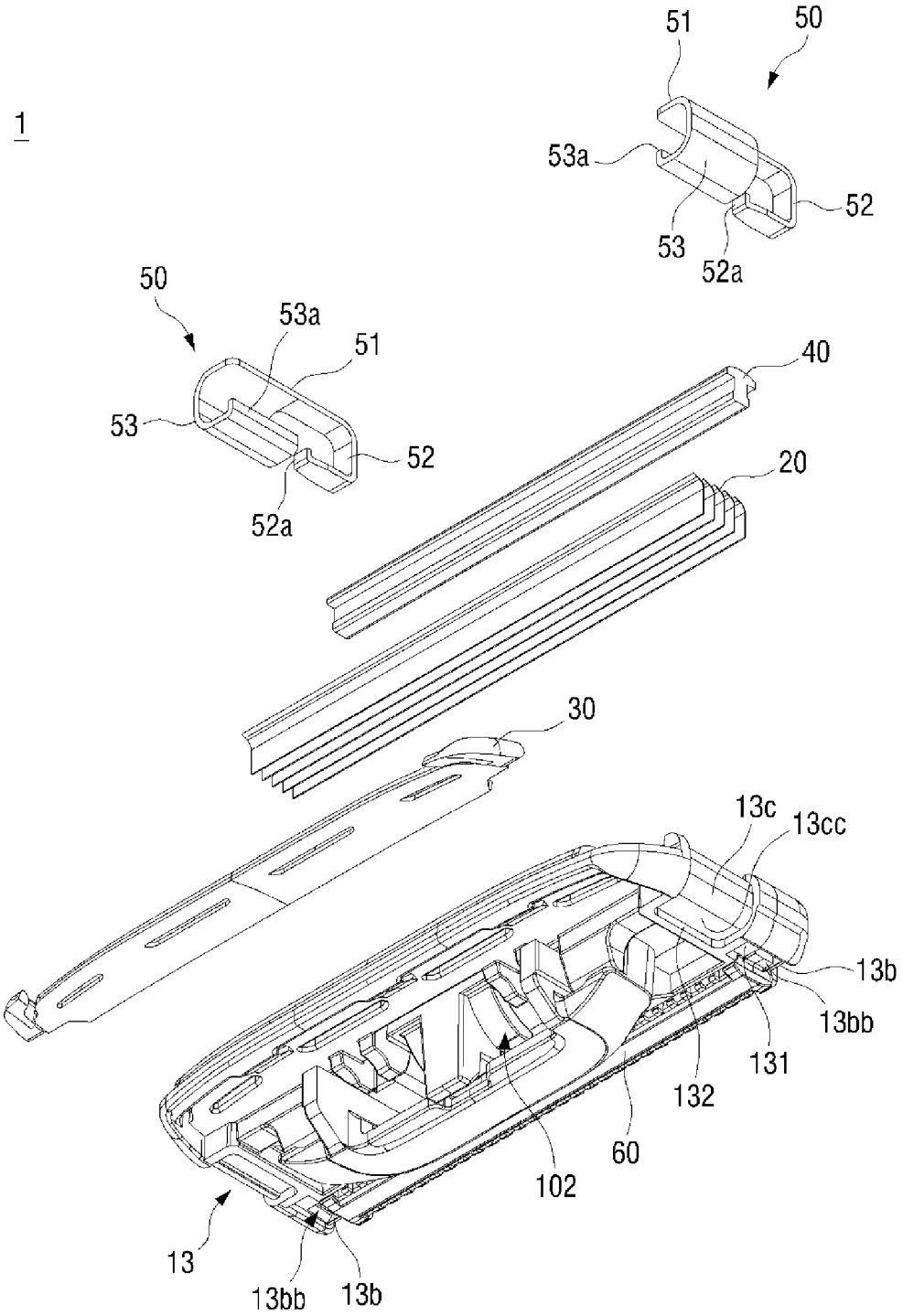
FIG. 5B is an exploded perspective view in the other direction of another embodiment of the retainer clips and channels in a razor according to at least one embodiment.

FIG. 5A is an exploded perspective view in one direction of another embodiment of retainer clips 50 and channels 13 in a razor 1 according to at least one embodiment. FIG. 5B is an exploded perspective view in the other direction of another embodiment of retainer clips 50 and channels 13 in the razor 1 according to at least one embodiment.

The FIGS. 5A and 5B illustrate another embodiment with a configuration and a structure similar to those of the above-described razor 1, but with improved fixing and holding forces, and the like when the retainer clip 50 is seated on the channel 13 and with such structural difference that adds hooks and notches to improve the retaining reliability. In the following description of the razor 1, the above description may apply in the common configuration or structure, and the focus may be on what is different in terms of configuration, structure, and the like.

The first holding leg 52 and the second holding leg 53 may be terminally formed with a first hook 52*a* and a second hook 53*a*, respectively. In at least one embodiment, the first hook 52*a* and the second hook 53*a* are provided at both ends of the first and second holding legs 52 and 53, for example. However, the present disclosure is not limited thereto, and other modifications or alterations are envisioned. For example, the first holding leg 52 alone may be formed with the first hook 52*a*, or the second holding leg 53 alone may be formed with the second hook 53*a*.

The first hook 52*a* may be bent inwardly at an end of the first holding leg 52 of the blade housing 10 toward the second surface 102. To seat the first hook 52*a*, the first wrapping channel 13*b* may be terminally formed with a first notch 131 at its position corresponding to the first hook 52*a*. Specifically, when only the first wrapping channel 13*b* is formed, the first notch 131 may be formed terminally of the first wrapping channel 13*b* at a position corresponding to the first hook 52*a*. In contrast, where the third wrapping channel 13*bb* is formed extending from the first wrapping channel 13*b*, the first notch 131 may be formed as the end of the third wrapping channel 13*bb*, at a position corresponding to the first hook 52*a*. With the first holding leg 52 bent in the manufacturing process, when a part of the first holding leg 52 is seated on the first wrapping channel 13*b* or the third wrapping channel 13*bb* formed on the second side 102 of the blade housing 10, the first hook 52*a* can be inserted into the first notch 131. This improves the retainer clip 50 in terms of the fixing and holding forces, and thereby improves the reliability of the retainer clip 50 thanks to the enhanced gripping force.

The second hook 53*a* may inwardly be bent at the distal end of the second holding leg 53 toward the first side 101. To seat the second hook 53*a*, the second wrapping channel 13*c* may be terminally formed with a second notch 132 at its position corresponding to the second hook 53*a*. Specifically, when only the second wrapping channel 13*c* is formed, the second notch 132 may be formed terminally of the second wrapping channel 13*c* at a position corresponding to the second hook 53*a*. In contrast, where the fourth wrapping channel 13*cc* is formed extending from the second wrapping channel 13*c*, the second notch 132 may be formed as the end of the fourth wrapping channel 13*cc*, at a position corresponding to the second hook 53*a*. With the second holding leg 53 bent in the manufacturing process, when a part of the second holding leg 53 is seated on the second wrapping channel 13*c* or the fourth wrapping channel 13*cc* formed on the second side 102 of the blade housing 10, the second hook 53*a* can be inserted into the second notch 132 and latched therewith. This improves the retainer clip 50 in terms of the fixing and holding forces, and thereby improves the reliability of the retainer clip 50 due to the enhanced gripping force.

Figure 6A:
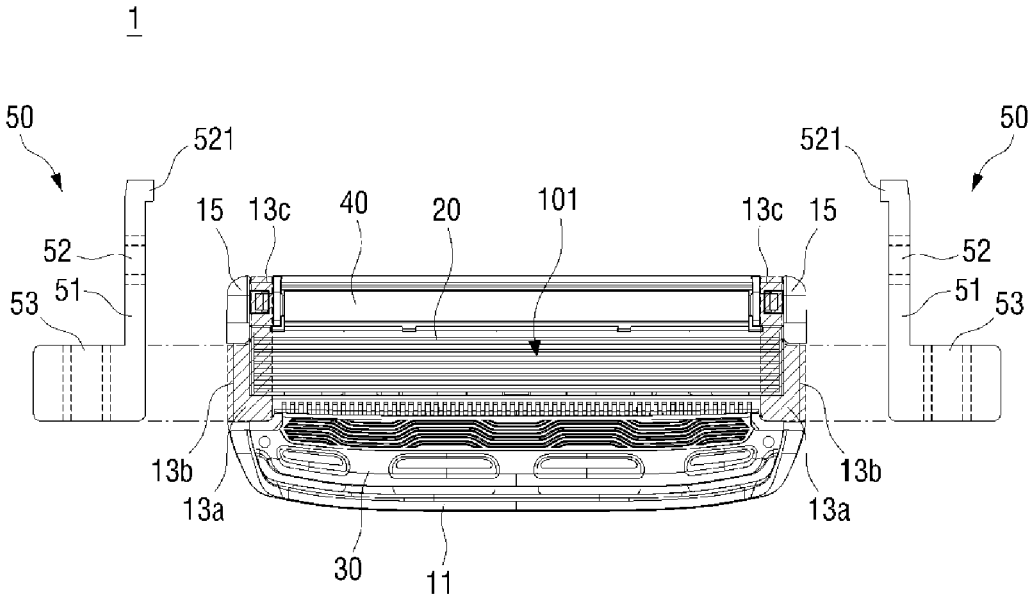
FIG. 6A is a plan view of retainer clips and a blade housing in a razor cartridge before coupling therebetween, according to another embodiment.
Figure 6B:
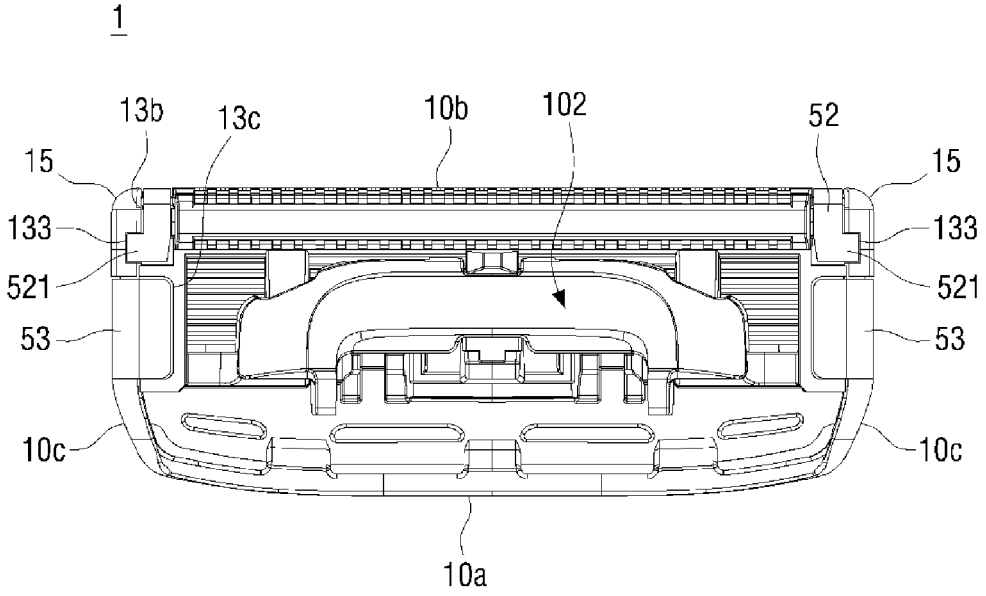
FIG. 6B is a bottom view of the razor cartridge shown in FIG. 6A.

FIG. 6A is a plan view of retainer clips 50 and blade housing 10 in a razor cartridge before coupling therebetween, according to another embodiment. FIG. 6B is a bottom view of the razor cartridge shown in FIG. 6A.

FIGS. 6A and 6B illustrate yet another embodiment with a configuration and a structure similar to those of the above-described razor 1, but with improved fixing and holding forces, and the like when the retainer clip 50 is seated on the channel 13 and with such structural difference that adds hooks and notches and with modifications to those illustrated in FIGS. 5A and 5B. In the following description of the razor 1, the above description may apply in the common configuration or structure, and the focus may be on what is different in terms of configuration, structure, and the like.

The first holding leg 52 or the second holding leg 53 may be terminally formed with a hook 521. In at least one embodiment, the hook 521 is provided at the end of the first holding leg 52, for example. However, the present disclosure is not limited thereto, and other modifications or alterations are envisioned. For example, the hook 521 may be formed on both the first holding leg 52 and the second holding leg 53, or on the second holding leg 53 alone.

The hook 521 may protrude from the distal end of the first holding leg 52 toward the side face 10*c* of the blade housing 10. To seat the hook 521, the first wrapping channel 13*b* may be terminally formed with a notch 133 at its position corresponding to the hook 521. Alternatively, where the hook 521 is formed in the second holding leg 53, the notch 133 may be formed in the second wrapping channel 13*c*. Where the hook 521 is formed in both the first holding leg 52 and the second holding leg 53, the notch 133 may be formed in both the first wrapping channel 13*b* and the second wrapping channel 13*c*.

When the first holding leg 52 is seated on the first wrapping channel 13*b* or the third wrapping channel 13*bb* formed on the second side 102 of the blade housing 10, the hook 521 can be inserted into the notch 133. This can improve the fixing and holding forces of the retainer clip 50.

Where the hook 521 is terminally formed on the second holding leg 53, the notch 133 is positioned terminally of the second wrapping channel 13*c* or the fourth wrapping channel 13*cc*. In this case, when the second holding leg 53 is seated on the second wrapping channel 13*c* or the third wrapping channel 13*cc* formed on the second surface 102 of the blade housing 10, the hook 521 can be inserted into the notch 133. As a result, the fixing and holding forces of the retainer clip 50 in the second direction can be improved.

The combined formations of the hook 521 and the notch 133 on both the first and second holding legs 52 and 53 and in the first and second wrapping channels 13*b* and 13*c* can improve the fixing and holding forces in various directions.

Figure 7A:
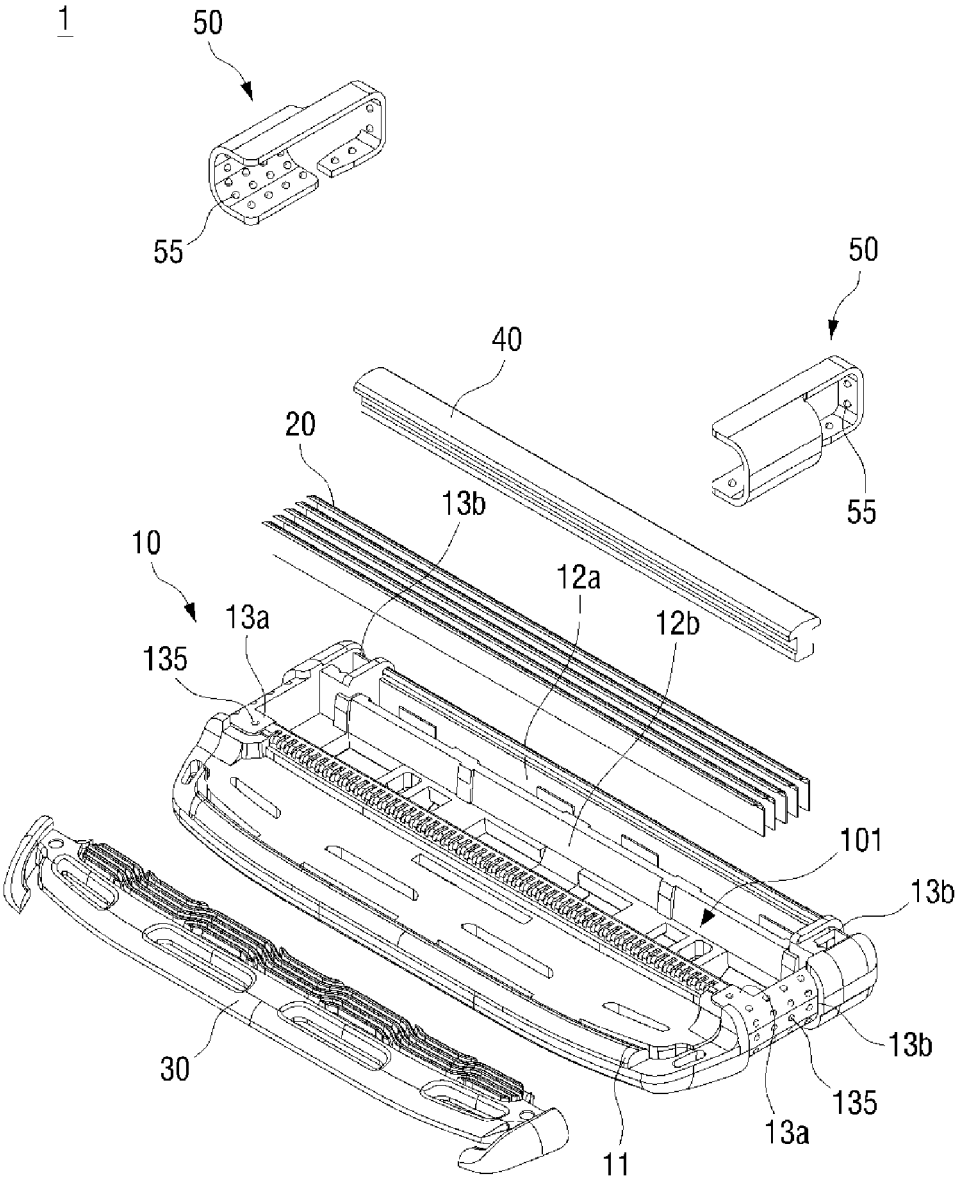
FIG. 7A is an exploded perspective view in one direction of the retainer clips and channels formed with supporting aids in a razor according to at least one embodiment.
Figure 7B:
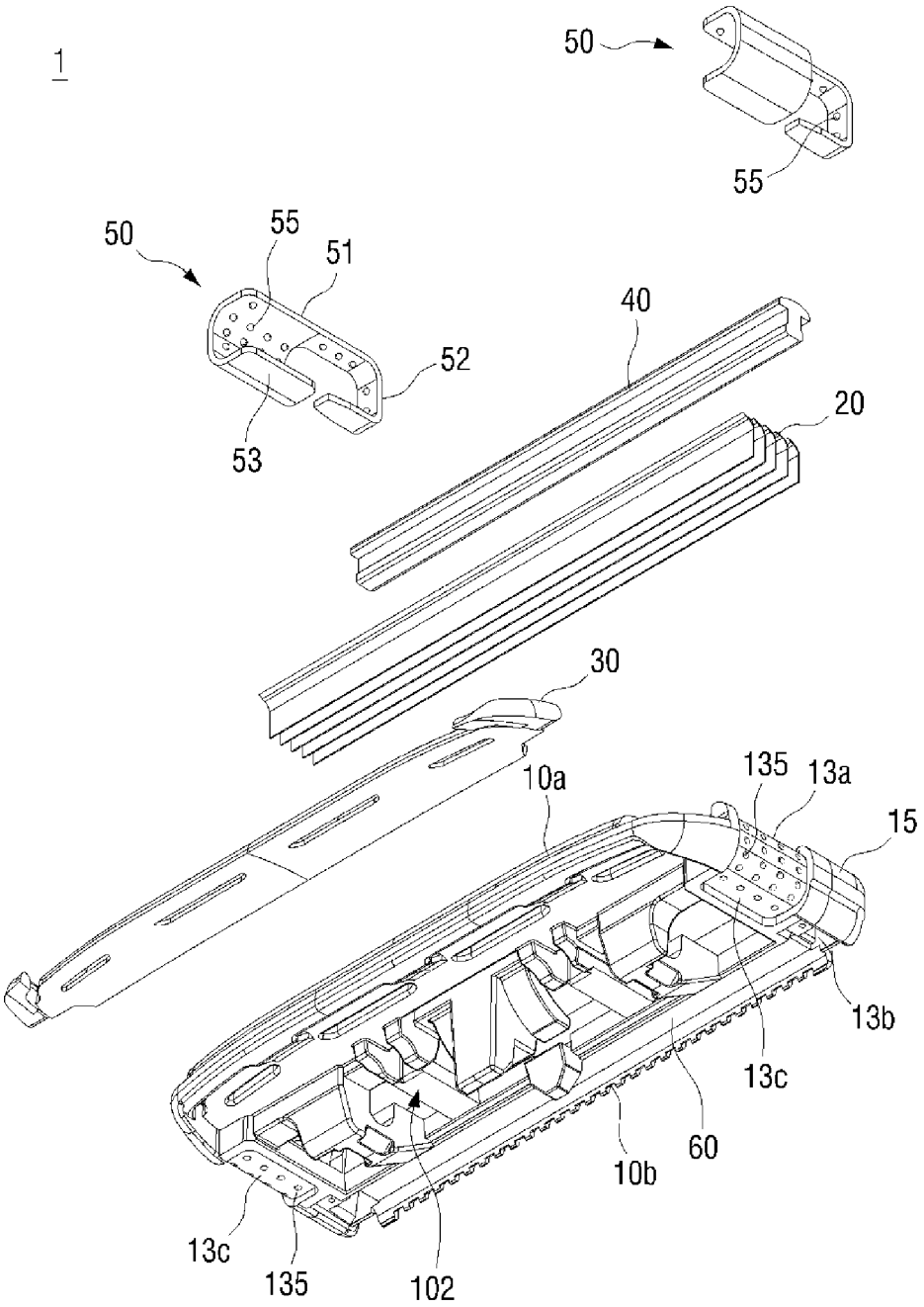
FIG. 7B is an exploded perspective view in the other direction of the retainer clips and channels formed with supporting aids in a razor according to at least one embodiment.

FIG. 7A is an exploded perspective view in one direction of the retainer clips 50 and channels 13 formed with holding assists 55 and 135 in a razor 1 according to at least one embodiment. FIG. 7B is an exploded perspective view in the other direction of the retainer clips 50 and channels 13 formed with the holding assists 55 and 135 in the razor 1 according to at least one embodiment.

FIGS. 7A and 7B illustrate yet another embodiment with a configuration and a structure similar to those of the razor 1 illustrated above referring to FIGS. 1 to 4, with a structural difference that adds the holding assists 55 and 135 for improving the fixing and holding forces of the retainer clip 50 when seated in the channel 13.

In the following description of the razor 1, the above description may apply in the common configuration or structure, and the focus may be on what is different in terms of configuration, structure, and the like.

The holding assists 55 and 135 may be formed on the inner surface of the retainer clip 50 and on the outer surface of the channel 13, respectively. The holding assists 55, 135 may include at least one protrusion 55 and at least one concave groove 135. The at least one protrusion 55 and the concave groove 135 may be formed in the retainer clip 50 and the channel 13, respectively. For example, when the at least one protrusion 55 is formed on the inner surface of the retainer clip 50, the at least one concave groove 135 may be formed in the channel 13. Conversely, when the at least one protrusion 55 is formed on the inner surface of the channel 13, the at least one concave groove 135 may be formed in the retainer clip 50. Hereinafter, the at least one protrusion 55 is formed in the retainer clip 50 and the at least one concave groove 135 is formed in the channel section 13. However, as described above, they may switch places with each other.

The at least one protrusion 55 may protrude from the inner surface of the retainer clip 50. Specifically, the at least one protrusion 55 may be formed on the inner surface of at least one of the base 51, the first holding leg 52 and the second holding leg 53. For example, the at least one protrusion 55 may be formed only in the base 51, but may be formed only in the first holding leg 52 or the second holding leg 53, or it may be formed in all of these sections.

The at least one concave groove 135 may be formed as a recess on the outer surface of the channel 13. Specifically, the at least one concave groove 135 may be formed in at least one of the receiving groove 13*a*, the first wrapping channel 13*b* (optionally along with third wrapping channel 13*bb*), and the second wrapping channel 13*c* (optionally along with the optional fourth wrapping channel 13*cc*). For example, the at least one concave groove 135 may be formed only in the receiving groove 13*a* in preparation to engaging with the at least one protrusion 55 formed only in the base 51. In addition, the at least one concave depression 135 may be formed in at least one of the first wrapping channel 13*b* and the second wrapping channel 13*c* in preparation to engaging with the at least one protrusion 55 formed in at least one of the first and second holding legs 52, 53.

When the retainer clip 50 is seated in and received by the channel 13, the at least one protrusion 55 engages with the at least one concave groove 135 and thereby improves the fixing, holding and coupling forces of the retainer clip 50.

For illustrative purpose only, the at least one concave groove 135 and the at least one protrusion 55 assume a hemispherical shape, but the present disclosure is not limited thereto. The concave groove 135 and the protrusion 55 may have any other modified or altered shapes as long as they limit the retainer clip 50 from moving around within the channel 13.

As described above, the retainer clip of the present disclosure is formed so as to wrap around and surround the blade housing from one side thereof to another side thereof, thereby providing a secure fixation of the retainer clip while minimizing interferences with other components.

It will be understood by those skilled in the art that the present disclosure may be embodied in other specific forms without departing from the technical idea or essential characteristics thereof. It is therefore to be understood that the above-described embodiments are illustrative in all aspects and not restrictive. The scope of the present disclosure is defined by the appended claims rather than the detailed description, and all changes or modifications derived from the meaning and scope of the claims and their equivalents are to be construed as being included within the scope of the present disclosure.

The invention claimed is:

1. A razor cartridge, comprising:

a plurality of shaving blades;

a blade housing comprising a blade seating space configured to receive the plurality of shaving blades in a second direction perpendicular to a first direction that is a shaving direction; and a pair of retainer clips configured to secure the plurality of shaving blades in the blade seating space, each retainer clip mounted at a corresponding side of the blade housing, wherein the pair of retainer clips are symmetrically shaped to each other, wherein each of the pair of retainer clips comprises:

a planar base portion positioned at a side end of a corresponding blade seating space, the base portion having a first end portion at one end of the base portion near a front face of the blade housing toward which edges of the plurality of shaving blades face, a second end portion opposite the first end portion, a third end portion located between the first and second end portions, and a fourth end portion opposite the third end portion;

a first holding leg extending from the second end portion of the base portion in the first direction and wrapped around the blade housing; and a second holding leg extending from the fourth end portion of the base portion in the second direction and wrapped around the blade housing.

2. The razor cartridge of claim 1, wherein:

the base portions cover both ends of the blade seating space; and a length of the base portion in the first direction is greater than or equal to a length of the blade seating space in the first direction.

3. The razor cartridge of claim 1, wherein an end portion of each of the base portions extends past a front most shaving blade among the plurality of shaving blades toward a front of the razor cartridge.

4. The razor cartridge of claim 1, further comprising recessed portions at the corresponding sides of the blade housing configured to accommodate the retainer clips such that the retainer clips are secured in position.

5. The razor cartridge of claim 4, wherein each of the recessed portions comprises channels extending across edges of the blade housing.

6. The razor cartridge of claim 4, wherein:

at least one of the base portion, the first holding leg, or the second holding leg of each of the retainer clips comprises at least one protrusion; and a corresponding one of the recessed portions comprises at least one depression corresponding to the at least one protrusion.

7. The razor cartridge of claim 4, wherein each recessed portion comprises:

a receiving groove configured to accommodate the base portion;

a first wrapping channel extending from the receiving groove and configured to accommodate the first holding leg; and a second wrapping channel extending from the receiving groove and configured to accommodate the second holding leg.

8. The razor cartridge of claim 7, wherein the blade seating space is formed at a front side of the blade housing and the first holding leg of the retainer clip is configured to wrap around the blade housing from the front side to a rear side of the blade housing opposite the front side.

9. The razor cartridge of claim 8, wherein the first wrapping channel extends from the front side to the rear side of the blade housing to accommodate the first holding leg therein.

10. The razor cartridge of claim 9, wherein:

a distal end of the first holding leg is formed with a first hook;

the rear side of the blade housing is formed with a first notch corresponding to the first hook; and the first notch is configured to receive the first hook.

11. The razor cartridge of claim 7, wherein the blade seating space is formed at a front side of the blade housing and the second holding leg of the retainer clip is configured to wrap around the blade housing from the front side to a rear side of the blade housing opposite the front side.

12. The razor cartridge of claim 11, wherein the second wrapping channel extends from the front side to the rear side of the blade housing to accommodate the second holding leg therein.

13. The razor cartridge of claim 12, wherein:

a distal end of the second holding leg is formed with a second hook;

the rear side of the blade housing is formed with a second notch corresponding to the second hook; and the second notch is configured to receive the second hook.

14. The razor cartridge of claim 1, wherein the first end portion is longer than the second end portion.

15. The razor cartridge of claim 14, wherein the third end portion is longer than the fourth end portion.

16. The razor cartridge of claim 1, wherein an entire area of an inner side of the base portion faces the blade seating space.

17. The razor cartridge of claim 16, wherein an entire area of an outer side of the base portion is exposed.

* * * * *